United States Patent [19]

Garot

[11] 3,939,574

[45] Feb. 24, 1976

[54] LINEN DRIER

[75] Inventor: Claude Garot, Colombes, France

[73] Assignee: Societe Universelle de Fabrication d'Appareils Menagers S.U.F.A.M., Colombes, France

[22] Filed: Jan. 27, 1975

[21] Appl. No.: 544,556

[30] Foreign Application Priority Data

Jan. 29, 1974 France ..... 74.2832

[52] U.S. Cl. ..... 34/163; 34/151; 34/239

[51] Int. Cl.² ..... F26B 9/00

[58] Field of Search ..... 34/90, 91, 99, 103, 201, 34/151, 163, 164, 230, 239–241, 243 R; 223/66; 219/366–372

[56] References Cited

UNITED STATES PATENTS

| | | | |
|---|---|---|---|
| 2,633,647 | 4/1953 | Jones | 34/151 |
| 3,256,617 | 6/1966 | Konstandt | 34/239 |
| 3,645,007 | 2/1972 | Scott | 34/99 |

FOREIGN PATENTS OR APPLICATIONS

| | | | |
|---|---|---|---|
| 1,260,057 | 3/1961 | France | 34/151 |

*Primary Examiner*—Kenneth W. Sprague
*Assistant Examiner*—James C. Yeung
*Attorney, Agent, or Firm*—Brisebois & Kruger

[57] ABSTRACT

A linen drier for mounting on a wall and in the form of a box equipped with means for blowing warm air in the direction of linen supported on horizontal bars. The bars extend longitudinally across the box parallel to the wall. The box carries a visor which pivots between an upper position in which it allows access to the linen and a lowered position in which it prevents access to the linen and at the same time guides the warm air towards the linen.

19 Claims, 10 Drawing Figures

LINEN DRIER

The present invention concerns a drier for linen.

Linen driers are already known which are in the form of a cupboard furnished with means for circulating warm air in the interior of the cupboard, in which the linen to be dried is placed.

These devices are cumbersome so driers that fold onto a wall were designed, these being generally in the form of a parallelopiped box which rests against the wall in its out-of-use position and is extended perpendicularly from the wall in its functional position so that its lower part presents a series of horizontal bars extending perpendicularly from the wall, this box-enclosure including some means for directing warm air onto the linen.

These devices are nevertheless equally cumbersome, particularly in their working position, moreover they do not make for efficient drying of the linen, which means for the user that there is a waste of time and an excessive consumption of electric current.

The present invention sets out to remedy the above inconveniences and to furnish a folding drier that is less cumbersome and which allows a more efficient drying of the linen together with all the advantages which accrue.

The invention has for its object, a linen drier of the wall type, comprising a box-enclosure furnished with means to blow warm air in the direction of the linen where horizontally disposed bars in the lower part of the box support the linen, characterised by the fact that the bars extend in the longitudinal direction of the box that is to say parallel to the wall, and that the aforesaid box includes a visor pivoting between a raised position and a lowered position, the visor being disposed in such a fashion that in the raised position it allows access to the horizontal bars and in the lowered position it prevents such access and, by its interior surface, contributes to the guiding of warm air towards the linen.

This visor can advantageously be made from plastic material, preferably transparent.

Conforming with the invention, the box is preferably in the form of a horizontal prism whose cross-section is a sector of a circle, the visor in its lowered position merging with the box to complete the section to a quarter-circle approximately.

In one improved and preferred embodiment of the invention, the bars are mounted on pivoting supports which allow the bars to be turned from the position of use in which they are horizontal, to an inclined position in which they extend along the lower face of the box in the form of a prism, thus reducing still further the cumbersomeness of the box when folded to its out-of-use position. These lateral supports are mounted advantageously to pivot on horizontal axis disposed towards the lower part of the box in a manner to allow the bars to be folded out of the way into an oblique position.

It is preferably to provide means for displacing the bars in a horizontal direction whilst keeping them aligned with the wall in order to make it more easy to load them with linen. This can advantageously be done by making the bars in the form of grills, the lateral extremities of which include means which can slide in the lateral supports for the grills.

The means for directing warm air onto the linen preferably comprises, a grill for the admission of air disposed preferably in the arched upper face of the box, one or more fans with their axes horizontal disposed under the abovementioned grill wall slightly inclined to the vertical and a front wall that is arched to merge with the visor in its lowered position, and if necessary some deflectors conveniently placed in the interior of the diffuser.

The current of air warmed by resistances conveniently placed downstream or preferably upstream of the fan, near the mouth of the diffuser, is thus directed downwards to pass between the pieces of linen suspended vertically from the bars.

By making the drier sufficiently long, the major part of the air circulates thus between the linen, only a small part of the air escaping from the two extremities and being lost, as compared with what happens in known wall driers where an important part of the air escapes in getting away from the wall, so much so that, in order to avoid this loss of air, it is necessary to provide a curtain or screen that is cumbersome and ugly, which is not necessary with the drier of the present invention.

In one particular embodiment, notably adapted to being manufactured in plastic material by injection moulding, the inside of the box of the drier includess two wing walls having the general form of a sector of a circle and provided at the lower part with a circular bearing and, perpendicular to the plane of the sector, a flange furnished with means for fixing against the wall of the room, the two said wing-walls having between them also a wall that is sensibly vertical and arched to form one wall of the diffuser for the fan this wall having at its centre some means of support for the fan motor, and in addition an upper wall that is arched and has an admission grill for the air. The box also has an anterior deflecting grill presenting horizontal deflectors and carried in an inclined fashion on the lateral wing-walls, this grill having an inwardly curved wall extending towards the interior of the box to form the upper part of the diffuser.

Other advantages and characteristics of the invention will become apparent in reading the following description, made as a non-limiting example and referring to the annexed drawings in which.

Figure 1:
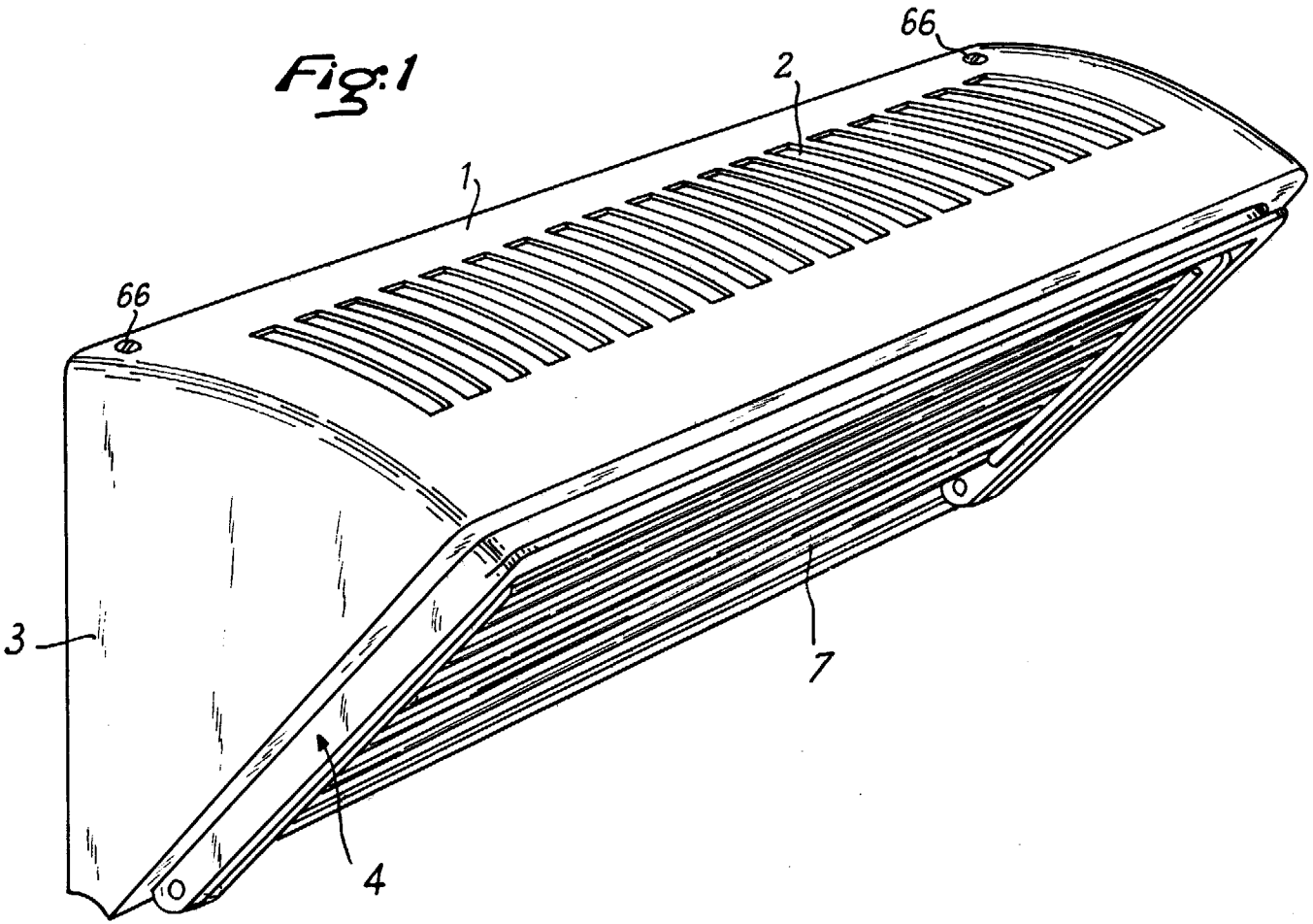
FIG. 1 shows a perspective view of a drier according to the invention in its out-of-use position.

Referring particularly to FIG. 1 there is seen a drier according to the invention which presents a box of generally prismatic form including one upper arched face 1, furnished with a grill for admission of air 2 and provided with two lateral wing-walls in the form of a sector of a circle 3, folded in the box there is a visor made of transparent plastic 4 which also has an upper arched surface and two lateral wing-walls in the form of a sector of a circle 6. Also there is shown, folded against the inclined face of the box, a grill 7 composed of horizontal bars. The external box 1, with its wing walls 3 contains also an arrangement consisting notably of two wing-walls 8 in the form of sectors of a circle, one rear wall 9 and an element 10 forming a deflecting grill.

Figure 2:
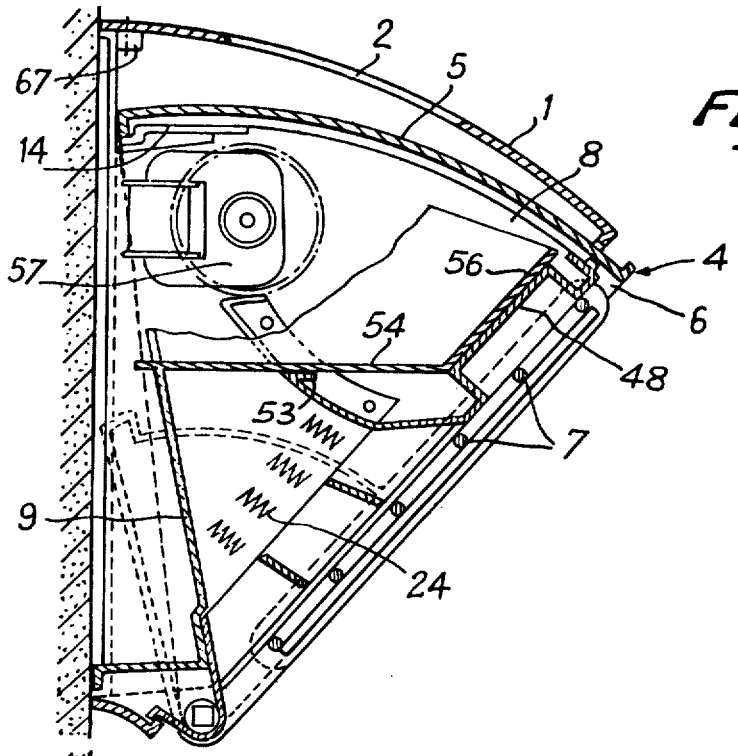
FIG. 2 shows a cross section of the drier in the same position.
Figure 3:
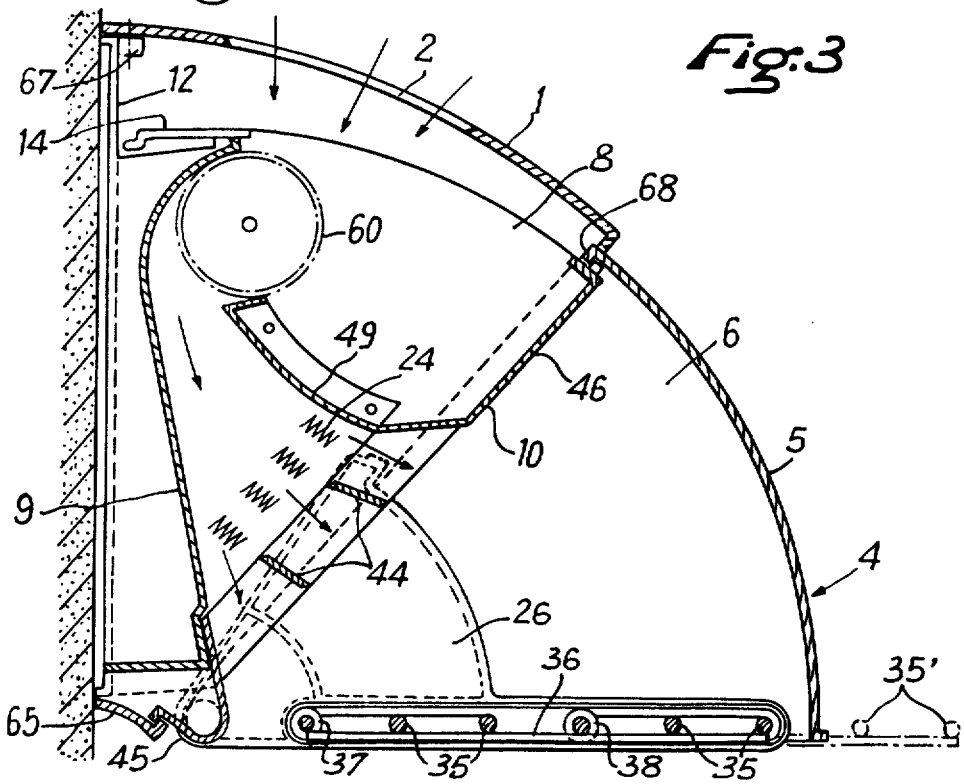
FIG. 3 shows a cross section of the drier in its functional position.
Figure 4:
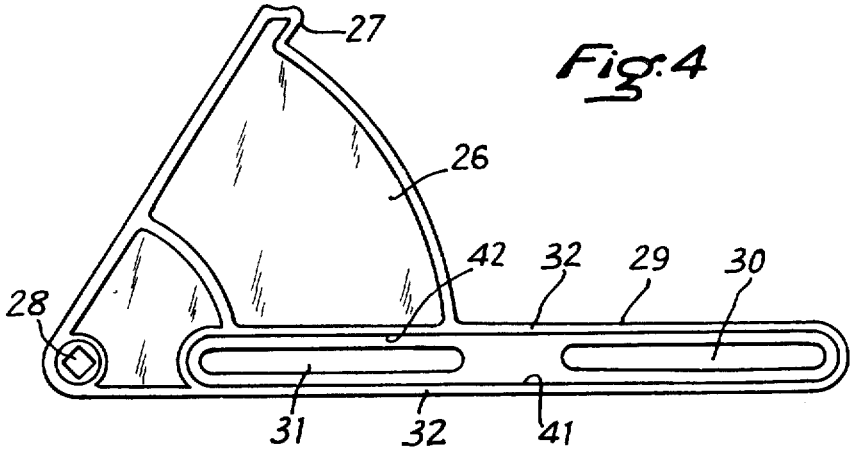
FIG. 4 shows a larger view of one of the lateral pivoting supports for the bars.
Figure 5:
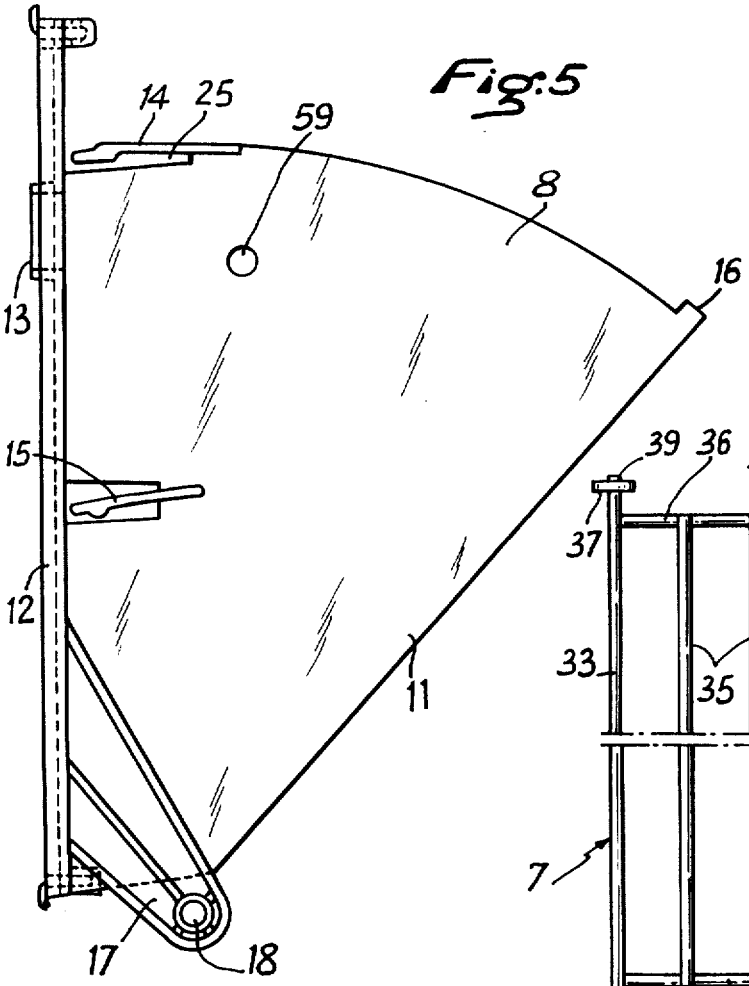
FIG. 5 shows a side view of one of the lateral wing-walls of the box.
Figure 6:
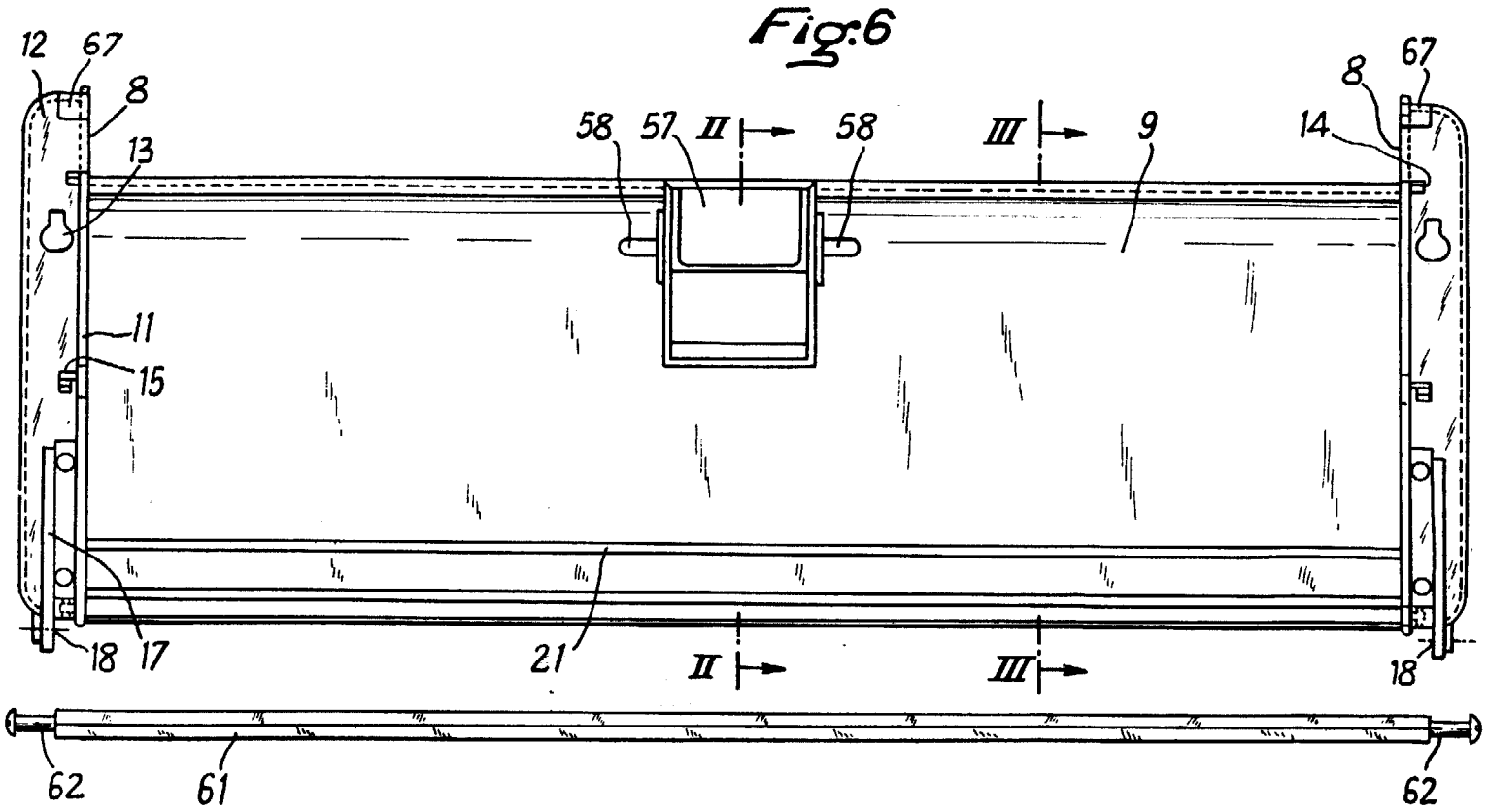
FIG. 6 shows an open view in elevation of the two wing-walls and the rear wall.
Figure 7:
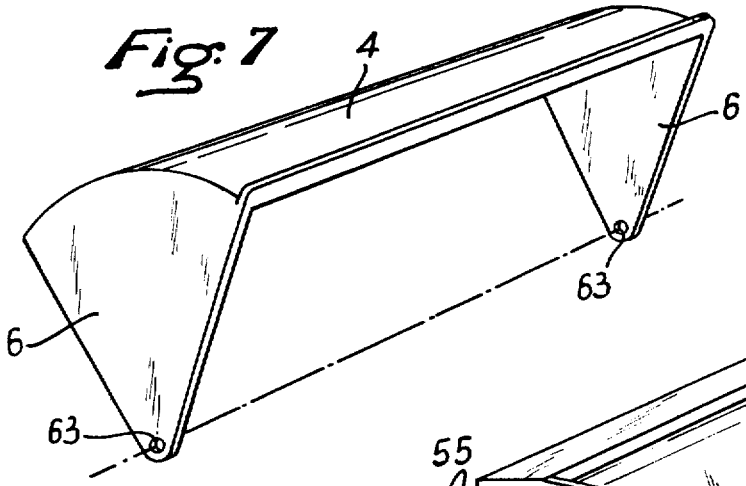
FIG. 7 shows a perspective view of the visor.

Each of the two internal wing-walls 8 as seen in FIGS. 5 and 6, consists of a plate 11 in the general form of a sector of a circle one edge of which is inclined and the other edge vertical, and joined to a raised flange 12 extending perpendicular to plate 11. This flange 12, which is for placing against the wall of the room, as seen in FIGS. 2 and 3, has a circular hole with an upper cutaway slot 13 for placing over the protruding head of a screw inserted in the wall of the room in well-known fashion. Also, plate 11 has, near the raised flange 12, two catches 14 and 15, one at its upper part and the other more or less at its middle height; the purpose of these two catches will be explained later. At the upper part of its inclined edge, plate 11 has a protrusion 16. Finally, the lower part of the raised flange 12 has an arm 17 extending obliquely downwards, and, a certain distance from plate 11, in a geometrical plane parallel to the aforesaid plate, below the level of the lower edge of plate 11 and flange 12, a circular hole 18 serving as a bearing.

Figure 8:
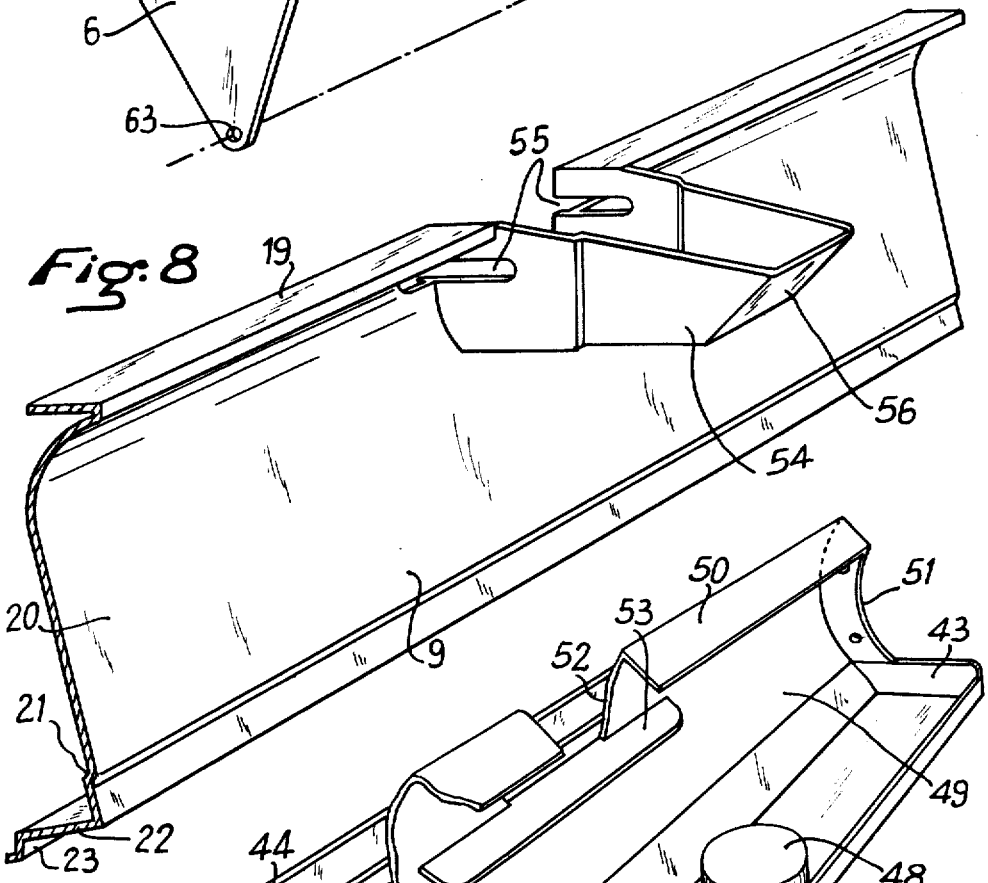
FIG. 8 is a perspective view of the rear wall.

The two internal wing-walls 8 are preferably moulded in one piece with the two extremes of the rear wall 9, the shape of which is shown particularly in FIGS. 6 and 8. This rear wall 9 has an upper flange 19 which is sensibly horizontal and which joins successively a wall 20, which, after a step 21 has again a flange 22 which extends towards the room-wall with a final step 23.

Grill 7, supported in its turn by two wing-walls 26 has also the form of a sector of a circle with a protrusion 27, and orifice of square section 28 disposed at the top and a radial prolongation 29 extending from the edge opposite to that with protrusion 27. This prolongation 29 has a radial slot 30 aligned with a second slot 31, of identical dimensions and located near the straight edge of wing-wall 26 that is elongated by the aforesaid prolongation 29. When the grill 7 is mounted between the wing-walls 26these wing-walls extend at the two ends of the grill in geometrical planes perpendicular to the grill. It can be seen also that the two slots 30 and 31 are surrounded by a continuous raised edge which stands in relief with regard to the wall 26 itself.

Figure 9:
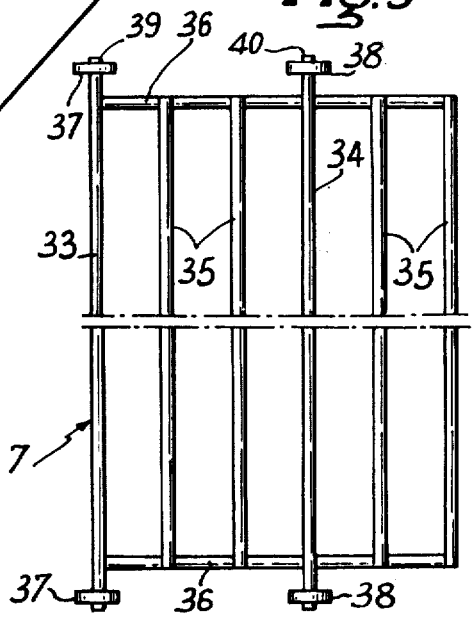
FIG. 9 is a view of the top of the grill.

Grill 7 has the form shown in FIG. 9 and it can be seen that it comprises 6 longitudinal bars extending parallel to the wall. The first bar 33 and the fourth bar 34 are longer than the other bars 35 the ends of which are joined by two transverse bars 36 which are fixed to bars 33 and 34. The outer ends of bars 33 and 34 each have a roller 37, 38 respectively, able to turn on its axle and at the same time being prevented from axial movement by means of any convenient classical means. It can be seen that the bars 33 and 34 have outer end parts such as 39 and 40 respectively which extend beyond the rollers 37, 38, these outer end parts penetrating respectively into the slots 31 and 30. When these end parts penetrate thus into the slots 31 and 30, the rollers 37, 38, are positioned on the inside of the continuous raised edge 32. In this manner in the position shown in FIG. 3, in which the prolongation 29 is horizontal, the rollers 37 and 38 can roll on the upper horizontal face 41 of the lower part of the raised edge 32 which thus serves as a rail. The lower face 42 of the upper part of raised edge 32 serves to prevent the rollers 37, 38 from moving away from this surface 41, the surrounding raised rim 32 thus forming a double guide rail for the rollers 37 and 38.

It will be understood that it is possible to move the grill when it is mounted between the two wing-walls 26, from the position shown in full lines in FIG. 3, in which roller 37 is disposed against the rear of the left part of rim 32 and the position shown in broken lines at 35′, in which the rollers 38 rest against the rear of the right edge of the rim 32. In this second position, aligned with the wall of the room, the operator can easily load linen upon bars 35, 37 and 38.

Figure 10:
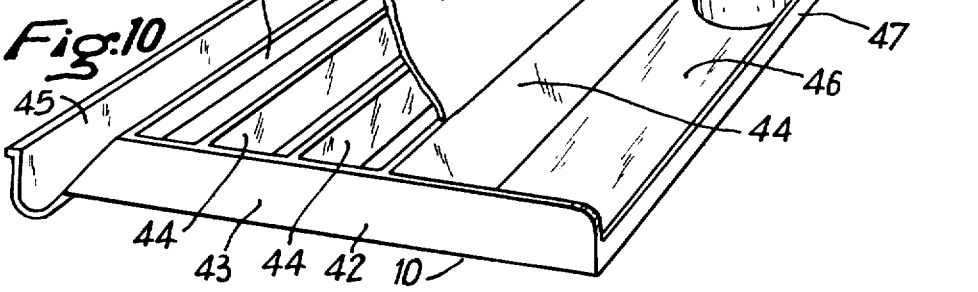
FIG. 10 is a perspective view of the deflector element.

The element forming deflector 10 has a shape shown in FIG. 10. This element comprises a first part 42 composed principally of two lateral members 43 joined by four elements in the form of a venetian blind 44, the two end slats of which are joined, the one to a curved extension 45 and the other to a bottom plate 46 which terminates in a raised edge 47, the bottom plate having a circular raised hollow position 48. The second part of element 10 has notably, an arched wall 49 with an upper inclined raised edge 50 and two raised edges at the sides, furnished with holes 51.

It can be seen that in the middle upper part of wall 49 there is a cut-out 52 the lower part of which has a step 53 extending from the surface of wall 49. This cut-out 52 is arranged to co-operate with a tray 54 which is situated in the upper middle part of wall 20 of part 9, the two lateral side-walls of this tray 54 open at the top, have slots 55 one part of which extends at right angles into wall 20.

Mounting of the drier is effected as follows:

Part 49 is fixed between the two wing walls 8 which are presented by wall 9 and is supported by its raised sides 51 between the plates 11 of these two wing walls against which it is fixed by means of screws or other convenient means of fixation through the holes provided. The lower part of element 10 is thus fixed as can be seen in FIGS. 2 and 3, in such a way that one of the louvres 44 lies in prolongation of wall 49. There has thus been constructed an air diffuser, the section of which is clearly seen in FIG. 3, in which the diffuser extends through the whole space between the two plates 11. The upper central part of this diffuser is obstructed by tray 54 which passes through the cut-out 52, as seen in FIG. 2, the bottom of tray 54 resting on step 53, in such a manner that its end 56, furnished with convenient orifices (not shown) rests on the raised hollow portion 48 which is also provided with orifices (not shown).

Tray 54 receives a motor 57 the shaft of which 58 comes out of the motor on one side and the other through slots 55. The motor is fixed in the tray by any convenient means (not shown). The motor shaft 58 is geometrically aligned with the two holes 59 arranged in the two plates 11, and it is thus possible to mount, between hole 59 and the corresponding end of shaft 58, a fan motor of squirrel-cage shape as shown schematically in FIG. 3 at 60. It is to be understood that hole 59 in which the end of the fan rotor 60 is mounted could be replaced by a pillow-block bearing in a convenient way to support the rotor, the other end of which is mounted on shaft 58. In this way, two rotors are mounted, one each side of the motor.

Furthermore, convenient control means, such as a switch or automatic timer are positioned in the housing 48 and are electrically connected to the motor 47 and a resistance 24 via passages provided in the bottom of the housing and in the bottom plate 56. It will be understood that when the two rotors are turned by means of motor 57, a circulation of air is created in the interior of the diffuser as represented by the arrows on FIG. 3.

Mounting of the movable elements, that is to say the wing-walls 26 which carry grill 7 as well as the visor 4, is made by means of a metal shaft 61 of square cross-section, having two ends 62 of circular section. The two wing-walls 26, carrying between them grill 7, are mounted upon a part of the square section of the shaft 61, by means of the holes 28. In turn, the visor 5 is mounted on shaft 61 by passing the circular ends 62 of shaft 61 through the holes 63 provided in the two side-walls 6 of the visor. The whole assembly, consisting of shaft 61 carrying by its square section part, the wing-walls 26 and the grill 7, and by its circular section — the visor 4, can now be mounted in the bearing 18 of the side-walls 8.

When the shaft 61 is thus mounted in these bearings 18 by its ends 62, the two wing-walls 26 which carry the grill, are contained in the spaces comprised respectively between the two plates 11 and the two arms 17, so that each side-wall 6 of the visor 4 is disposed on the outer side of the arm 17 which is nearest to it. Thus it comes about that the visor 64 and the side walls 26 cannot be moved axially, but are free to turn about shaft 61.

The assembly thus constituted by the rear wall 9, the diffuser element 10, the two fixed lateral side walls 8, shaft 61 the two wing walls 26 with their grill 7 and the visor 4, is then fixed in box 1, this fixing in box 1 being made by springing a part 45 of part 10 which surrounds shaft 61 into a corresponding raised edge of a cross member 65 in the lower part of box 1, and then, for fixing the higher part, screws 66 are used across the top of box 1 which are screwed into the holes provided in the raised parts 67 fixed to the upper part of the raised edges 12 of the side walls 8. It then only remains to suspend the drier against a wall and make the electrical connection by any convenient means (not shown).

To bring the drier according to the invention into use from the folded position shown in FIG. 2, the user must exert a downward pull on the bars of the grill 7, thus making the two side walls 26 which support the grill, pivot downwards when the two side walls by this pull are caused to free the protrusions 27 from the catches 15. From the folded position of the grill, the user then pulls the grill out from the wall, sliding it out between the side wall 26 and bringing it to the position shown at 35' allowing the loading of linen on the bars. After loading the linen thus, the grill is pushed towards the wall bringing it to the position shown in full lines in FIG. 3. After that, the user pulls on the visor 4 in order to make it come down, by this action releasing an edge of the visor 68 from being held by catches 14. After having thus swung the visor down, the user can switch on the motor 57 or start the automatic timer (not shown) which is in housing 48 and has thus become accessible.

In this lowered position, the air drawn in through grill 2 by the two fans 60, is warmed by the electrical resistance elements 24 which may be conveniently situated in the diffuser before of after the fans, and is blown into the diffuser constituted by walls 9, 10 and plates 11.

The air, suitably directed by the two intermediary elements 44 then blows into the interior of the visor from whence it departs by the grill 7 and passes then between the pieces of linen suspended from the bars of the grill.

After drying, the user lifts visor 4 by rotating it until it catches its edge 68 in the catches 14, and then activates the switch or automatic timer in housing 48 in order to stop the motor and shut off the heating resistances, after which he pulls the grill to position 35' in order to take out the linen he then pushes in the grill and rotates it upwards in order to engage the protrusions 27 with catches 15 and returns all to the folded position as shown in FIG. 2.

Different electrical safety measures can be provided. In particular, a general switch, such as a micro switch, could be provided to be activated by protrusion 68 of the visor 5 when the latter is brought to the position shown in FIG. 3. Whenever the visor is lifted, the electric current would be cut.

Two transversal deflectors, parallel to wall 8 can be provided in diffuser 9 in order to direct part of the air under part 54.

What we claim is:

1. Linen drier adapted to be mounted on a wall, said drier comprising a box having one side adapted to lie against said wall and being equipped with means for producing a current of hot air, a visor mounted to pivot about an axis parallel to said one side between a retracted position adjacent the top of said box and an extended and lowered position in which it projects further away from said box, two supports mounted to pivot independently of said visor about an axis parallel to said one side between a retracted position lying mainly within said box and a lower position lying mainly outside said box, said supports being positioned inside said visor and carrying a set of wires which are parallel to said one side of said box, said visor permitting access to said wires when said supports are in their extended position and said visor is in its retracted position and guiding said current of air toward said wires when both visor and supports are in their extended positions.

2. Drier as claimed in claim 1, in which said visor is mounted to telescope into said box beneath the upper part thereof, and comprises a part-cylindrical portion parallel to its axis and two end walls transverse to that axis supporting said part-cylindrical portion, while said box is provided with guide members parallel to and closely adjacent said end members, said guide members being positioned between said end members.

3. Drier according to claim 1, in which the visor is made of transparent material.

4. Drier according to claim 1, in which the box is in the form of a horizontal prism, the cross section of which is a sector of a circle, the visor in lowered position completing the said sector to a quarter circle.

5. Drier according to claim 1 which includes means for displacing the bars horizontally by bringing them away transversely from the wall in order to facilitate loading them.

6. Drier according to claim 5, in which the said bars constitute a grill the two lateral extremities of which comprise means which can slide in the lateral supports of the bars.

7. Drier according to claim 1, in which the means for producing a current of warm air comprise a grill for admission of air disposed in the upper face of the box, at least one fan with its axis horizontally disposed under said grill and a diffuser having a rear wall slightly inclined to the vertical and a forward arched wall which joins substantially with the visor in its lowered position.

8. Drier according to claim 7, in which the said diffuser includes deflectors for guiding air which are disposed in the direction of the anterior face of the drier.

9. Drier according to claim 7, in which the drier box includes two lateral wing-walls having the general form of a sector of a circle having at their lower part a circular bearing and perpendicular to the plane of the sector of the circle, a flange furnished with means for attaching it to the wall of the room, the said two wing-walls supporting said rear wall as well as said arched wall, which terminates in a deflecting grill forming the lower face of the box.

10. Drier according to claim 9, in which the said bearing is carried by an arm extending parallel to and a certain distance from the circular arc of the wing-wall.

11. Drier according to 5 in which the said supports for the bars are constituted by movable wing-walls in the form of a sector of a circle and having a radial elongated portion furnished with means for guiding the bars.

12. Drier according to claim 11, in which the said guiding means consist of a double raised portion forming a guide rail for rollers supported on the ends of the grill constituted by the bars.

13. Drier according to claim 11, in which the said bar supports have a protrusion which can co-operate with a holding catch carried by the fixed wing-wall on the inside of the box.

14. Drier according to claim 7 and, in which the said rear wall has a tray extending from the upper part of said wall transversely with respect to said wall and being furnished with means for supporting a motor for driving the fan.

15. Drier according to claim 14, in which the lower part of said tray rests against the end of a hollow raised portion made in the lower wall of the drier box, the said hollow raised portion housing the means for electrically activating the drier.

16. Drier according to claim 9, in which the said wing-walls carry at their upper part a catch co-operating with a raised edge of the upper part of the visor in order to hold the visor in its upper position.

17. Drier according to claim 9 and, in which the said arms are disposed outside the diffuser, that the said wing-wall supports of the bars are held respectively between the arms and the fixed side walls and that the visor presents two lateral side walls extending one side and the other, to the outside of the said two arms, said sidewalls supporting the grill and the lateral sidewalls of the visor being supported by a single shaft mounted on the bearings carried by said arms.

18. Drier according to claim 17, in which the said shaft has one part of square cross section on which are mounted the said bar supports by holes of corresponding square section.

19. Drier according to claim 1, including a switch which cuts off the current when the visor is raised.

* * * * *